US008896148B2

(12) United States Patent
Berthold et al.

(10) Patent No.: US 8,896,148 B2
(45) Date of Patent: Nov. 25, 2014

(54) USE OF AUXILIARY CURRENTS FOR VOLTAGE REGULATION

(75) Inventors: Joerg Berthold, Munich (DE); Peter Mahrla, Zomeding (DE); Stephan Henzler, Munich (DE); Vincent Gouin, Mandelieu (FR); Fan He, Nice (FR)

(73) Assignee: Infineon Technologies AG, Neubiberg (DE)

( * ) Notice: Subject to any disclaimer, the term of this patent is extended or adjusted under 35 U.S.C. 154(b) by 1190 days.

(21) Appl. No.: 12/820,259

(22) Filed: Jun. 22, 2010

(65) Prior Publication Data

US 2011/0309814 A1 Dec. 22, 2011

(51) Int. Cl.
*G05F 3/02* (2006.01)
*G05F 1/46* (2006.01)

(52) U.S. Cl.
CPC ..... *G05F 1/46* (2013.01)
USPC ..... 307/29; 307/72

(58) Field of Classification Search
USPC ..... 307/9.1, 10.1, 59, 29, 85–87, 72, 74, 307/75, 103, 71, 24, 28; 713/300, 310, 330; 455/127.1, 572; 365/227
See application file for complete search history.

(56) References Cited

U.S. PATENT DOCUMENTS

| | | | | |
|---|---|---|---|---|
| 5,068,825 | A * | 11/1991 | Mahant-Shetti et al. | 365/154 |
| 5,801,572 | A * | 9/1998 | Nakamura | 327/434 |
| 6,353,894 | B1 * | 3/2002 | Pione | 713/340 |
| 6,756,773 | B2 * | 6/2004 | Koretsky et al. | 323/234 |
| 6,801,419 | B2 | 10/2004 | Fukui | |
| 7,602,162 | B2 | 10/2009 | Bansal et al. | |
| 7,603,572 | B2 | 10/2009 | Berthold et al. | |
| 8,055,854 | B2 * | 11/2011 | Sohn et al. | 711/149 |
| 2006/0044882 | A1 | 3/2006 | Nahas | |

FOREIGN PATENT DOCUMENTS

| | | | |
|---|---|---|---|
| DE | 102005029110 | A1 | 12/2006 |
| WO | 02093340 | A1 | 11/2002 |

* cited by examiner

*Primary Examiner* — Fritz M Fleming
(74) *Attorney, Agent, or Firm* — Eschweiler & Associates, LLC

(57) ABSTRACT

One embodiment relates to an apparatus that includes at least one circuit block and a voltage source configured to supply a first voltage to the at least one circuit block. The apparatus also includes a power delivery unit configured to be selectively activated based on a whether a quantity of power is to be delivered from the power delivery unit to the circuit block. A control unit is configured to, upon a change in power consumption of the at least one circuit block, activate the auxiliary power delivery unit to deliver the quantity of power to the circuit block. The auxiliary power delivery unit can quickly supply large currents since it does not necessarily rely on slow control loops using voltage sensing. Rather, the auxiliary power delivery unit often delivers pre-calculated current profiles to respond to the timing characteristic of the change of power consumption and of the voltage regulator.

19 Claims, 8 Drawing Sheets

USE OF AUXILIARY CURRENTS FOR VOLTAGE REGULATION

BACKGROUND

To ensure reliable operation of devices that contain digital circuits, designers attempt to limit or minimize fluctuations in supply voltage. The fluctuations of a supply voltage can have static and dynamic portions. The static portion is often attributable to tolerances of components within the circuitry used to generate the supply voltage. The dynamic portion of the fluctuations is often primarily attributable to changes in load (e.g., change in power requirements for a load). In conventional circuits, load changes with factors of up to 10 are quite commonplace, and can occur from one clock to the next, which often equates to a few nanoseconds.

FIG. 1 shows a prior art digital circuit 100. This digital circuit 100 has a voltage source 102 with a capacitor 104 coupled to its output, wherein the voltage source 102 feeds a circuit block 106 arranged on a circuit board or a chip 108. The lines coupling the voltage source 102 to the circuit block 106 are symbolized by two parasitic resistors 110 and two parasitic inductors 112. To optimize delivery of power from the voltage source 102, blocking capacitors 114 are provided, which serve to buffer charge for load changes.

As can be seen from FIG. 2, if the circuit block 106 is initially in a low current state during time 202 (e.g., requiring 50 mA) and is at time 204 switched to a high current state (e.g., requiring 350 mA), a sudden change in 300 mA of current is required (e.g., within a duration of 10 ns). In mobile telephones, for example, the low current state can be used for low performance applications (e.g., mp3 or speech processing), and the high current state can be used for high performance applications (e.g., high-speed data transfer and multimedia processing). The blocking capacitors 114 provided in FIG. 1 are either too slow or too small to be able to balance out these sudden load changes, causing voltage fluctuations 206 and 208 to arise in the supply voltage VDD' (relative to VSS'). These dynamic voltage fluctuations can be +/−50 mV, so that the supply voltage VDD' can fluctuate between VDDmax and VDDmin. This fluctuation in amplitude at low supply voltages of around 1V can cause the switching speed of devices in the circuit block 106 to be reduced by up to 10% during periods of up to several μs.

Although the use of blocking capacitors 114 may mitigate these supply voltage fluctuations 206, 208 somewhat, on-chip blocking capacitors alone are less than ideal for several reasons. For example, on-chip capacitors mostly have only low capacitances and are expensive in terms of their chip area requirement. Therefore, blocking capacitors are not in-and-of-themselves sufficient to eliminate or reduce the dynamic fluctuations of the supply voltage.

Consequently, the inventors have developed improved techniques for eliminating or reducing the dynamic fluctuations in a supply voltage VDD'.

DETAILED DESCRIPTION

Figure 1:
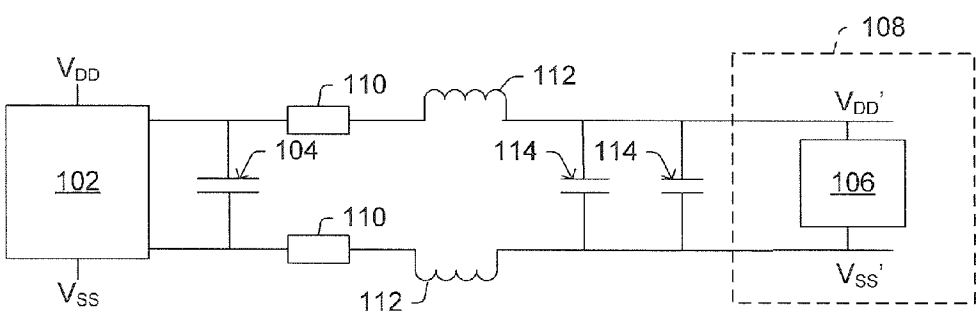
FIG. 1 (Prior Art)
FIG. 1 illustrates a digital circuit according to prior art.

The claimed subject matter is now described with reference to the drawings, wherein like reference numerals are used to refer to like elements throughout. In the following description, for purposes of explanation, numerous specific details are set forth in order to provide a thorough understanding of the claimed subject matter. It may be evident, however, that the claimed subject matter may be practiced without these specific details.

Figure 2:
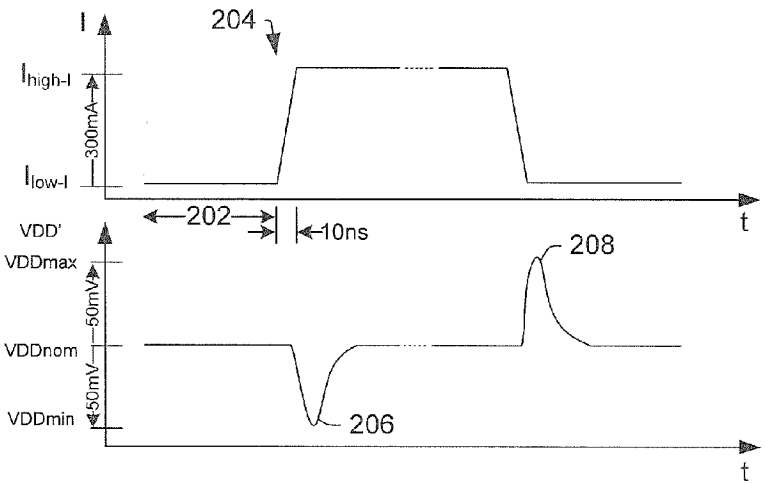
FIG. 2 (Prior Art)
FIG. 2 illustrates a current change and the induced voltage fluctuations in the circuit of FIG. 1.
Figure 3:
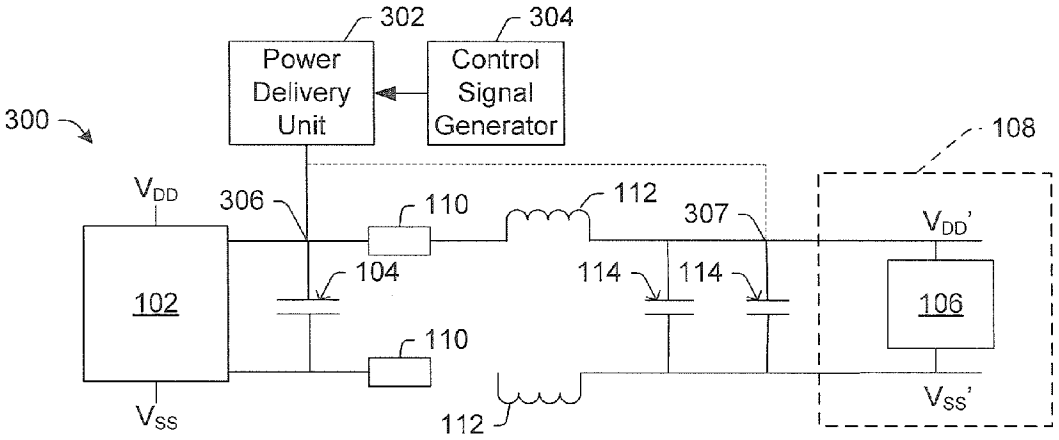
FIG. 3 illustrates a circuit in accordance with some embodiments.

To reduce supply voltage fluctuations, a circuit 300 as shown in FIG. 3 is provided. The circuit shown in FIG. 3 is similar to the circuit shown in FIG. 1, so that similar elements carry the same reference numerals and are not described in further detail. To reduce the voltage fluctuations shown in FIG. 2, the circuit 300 includes an auxiliary power delivery unit 302. This power delivery unit 302 receives a control signal from a control signal generator 304, such that the power delivery unit 302 is operable to supply auxiliary current in the event of a change in power requirements of the circuit block 106, thereby reducing voltage fluctuations relative to previous solutions. Although the auxiliary power delivery unit 302 can be arranged to deliver this auxiliary "on demand" current off-chip at 306, it can alternatively be arranged to deliver power on-chip at node 307. In instances where the auxiliary power delivery unit 302 delivers its current on-chip at 307, any negative impact of the wire inductances can be limited.

Figure 4:
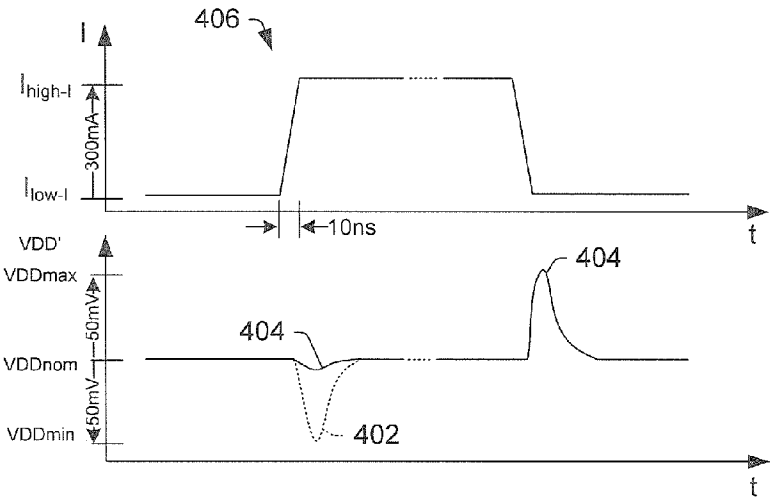
FIG. 4 illustrates a load change in the use of the circuit of FIG. 3.

FIG. 4 shows the current and voltage curves for circuit 300 over time, with a load change of +300 mA occurring within the circuit 300. The voltage curve without the power delivery unit 302 is shown with a dashed line 402, while the voltage curve in the presence of the auxiliary power delivery unit 302 is shown with a solid line 404. As can be seen from the voltage curve of FIG. 4, if it is determined that a load change with increased load is imminent (e.g., at time 406), the control signal generator 304 activates the auxiliary power delivery unit 302 in such a way that the auxiliary power delivery unit 302 provides auxiliary current as the load change occurs.

More specifically, when the current draw of the circuit block 106 actually starts to increase at 406, the power delivery unit 302 supplies current in an amount proportional to what is required to accommodate the load change, such that the amount of voltage undershoot relative to previous solutions is significantly reduced. By reducing "undershoot" 402, this configuration allows designers to reduce the nominal supply voltage VDDNom relative to previous solutions, while still ensuring that sufficient power is supplied to the circuit block 106 at all times. In reducing the nominal supply voltage VDDnom (relative to previous solutions), this configuration helps to facilitate lower power operation than previously achievable. For example, if the VDDNom is reduced by 5% (relative to previous solutions), the configuration of FIG. 3 can provide a power reduction of approximately 10% in some instances, which is a significant improvement.

In embodiments disclosed herein, the activation of the power delivery unit 302 is carried out without the use of voltage or current detectors that directly measure the current flow in the chip 108. Rather, the power delivery unit 302 is activated by a control signal from the control signal generator 304, which does not require measurement of current flow or voltage levels in the chip. For example, in one embodiment, the control signal is generated by a software program module based on when a change in mode occurs. For instance, if the circuit in FIG. 3 is included as part of a mobile communications device (e.g., cell phone, personal digital assistant, iPhone®), the mobile communications device may abruptly switch between a relatively low-power processing mode (e.g., playing an .mp3 audio file) and a high-power high-speed wireless communications mode (e.g., IP TV). When this change in mode occurs, software running on the mobile communications device can induce a change in the control signal generator 304 which, in turn, changes the state of the control signal. This change in state of the control signal activates the power delivery unit 302 so that it supplies auxiliary power to accommodate the switch to the relatively high-power mode without undesirable voltage swing.

Figure 5:
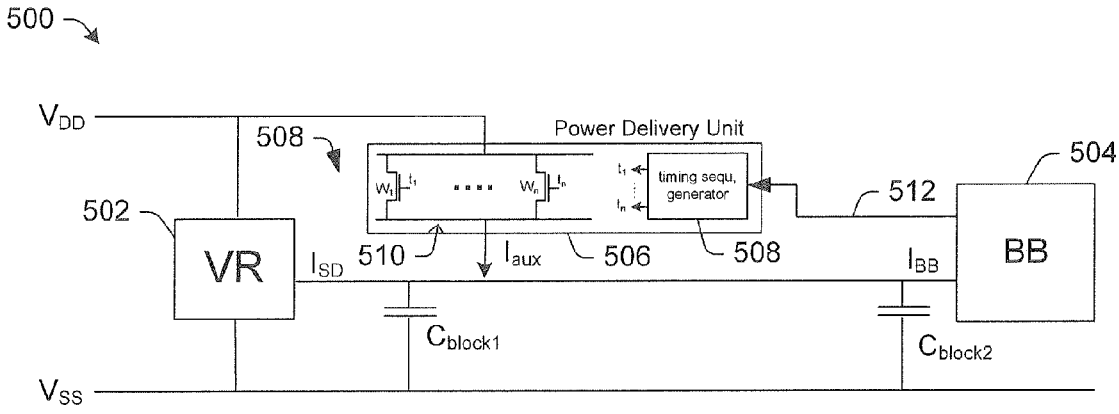
FIG. 5 illustrates an example of a circuit in the context of a mobile communications device.
Figure 6:
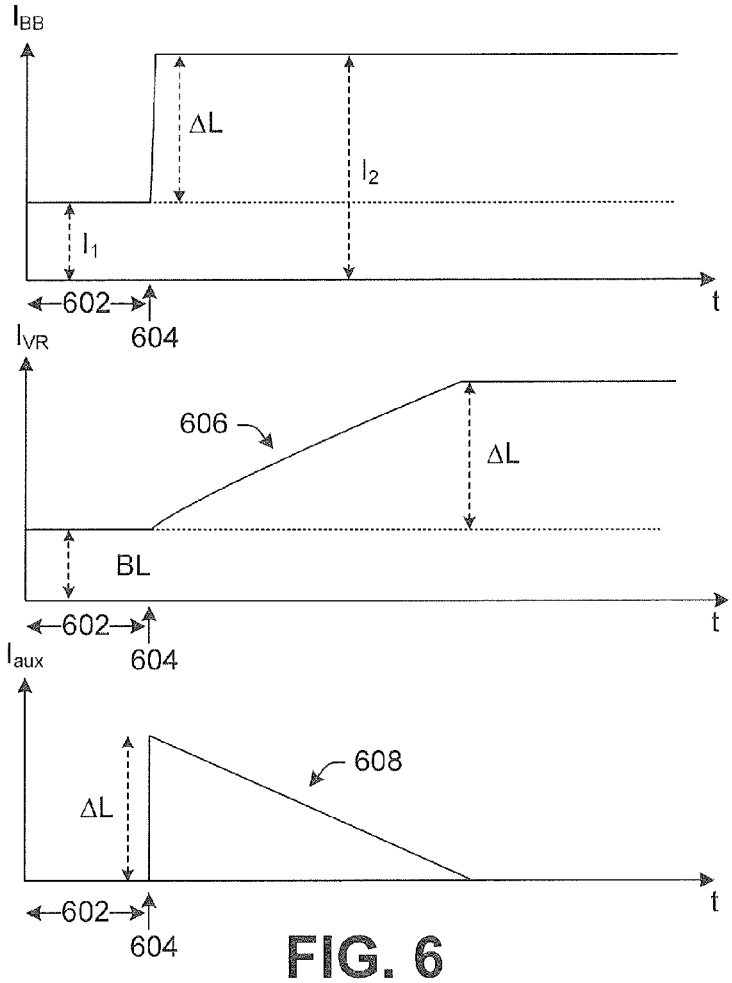
FIG. 6 illustrates a load change in the use of the circuit of FIG. 5.

FIGS. 5-6 are now discussed in the context of a mobile communications device 500, which includes a voltage regulator 502, a baseband processor 504, and an auxiliary power delivery unit 506 (e.g., power delivery unit 302 in FIG. 3). In this embodiment, the power delivery unit 506 includes a timing sequence generator 508 and a number of current elements 510. In some embodiments, the current elements 510 can comprise transistors, wherein the transistors can have different length-to-width ratios in some implementations.

During operation, the baseband processor 504 provides a control signal 512 indicative of a pre-determined current profile to be supplied by the power delivery unit 506. The timing sequence generator 508 translates the control signal 512 into a series of signals that individually activate the individual current elements 510. For example, if more current is desired, the timing sequence generator 508 can turn on more (and/or larger) transistors. Conversely, if less current is desired, the timing sequence generator can turn on fewer (and/or smaller) transistors.

As shown in FIG. 6, during time 602 the baseband processor 504 is initially in a low-current mode having a first current I1, corresponding to, for example, a user running an .mp3 player application on the mobile communications device. During this time, the voltage regulator 502 is capable of providing the power required by the baseband processor 504, so the auxiliary power delivery unit 506 remains off at this time.

However at time 604, the baseband processor changes to a higher-current mode having a second current $I_2$, corresponding to, for example, a user running a high speed communications service on the mobile communications device. Because the baseband processor 504 changes its current requirements so suddenly (e.g., within a few nanoseconds), the control loop of the voltage regulator with response times of several μs, when acting by itself, is unable to keep the voltage level at the required level and undershoots could occur. Therefore, to compensate for the voltage regulator's inability to account for this sudden increase in current demand, the auxiliary power delivery unit 506 delivers a suitable current to meet at least most of the demand increase of the baseband processor (see 608). The voltage regulator 502 is then able to cope with the auxiliary current demand since only a minor change is left. The regulator then slowly ramps the current up to the required level (see 606), whereas the auxiliary power delivery unit reduces its current (see 608). In this way, the sum of the currents from the voltage regulator and auxiliary power delivery unit collectively meet the increased demands of the baseband processor.

Determining an expected load increase for a change in operating mode can be done during the circuit design, i.e. prior to the beginning of operation. This determination relies on the observation that the power dissipation of the circuit block (e.g., baseband processor) depends predominantly on the clock frequency and the number of active registers (flip-flops) used for a mode of operation. Thus, a change in current demand by the circuit block (e.g., baseband processor 504) is typically more strongly influenced by how many registers or gates are active, on average, during a given mode. Within the given mode, the change in current demand is often largely independent of the actual data processed in that mode. For these reasons, a sudden increase in current demand is therefore primarily determined by a sudden increase of the clock frequency and/or by a sudden increase of the number of active registers. The latter takes place while using the clock-gating technique, the former is due to the frequency scaling technique. Since clock frequency and the number of active, i.e. clocked, registers are known in advance for each mode of operation, the corresponding increase of current demand (e.g., predetermined current profiles) can be determined prior to the beginning of operation.

The determination of the load increase can further be done during component verification using engineering samples of the chip. During the chip test the increase of current demand can be measured, and the power delivery unit on final versions of the chip can be configured in such a way, that a suitable current profile is delivered during actual operation.

Since amplitude and timing characteristic of the current profiles delivered by the supply delivery unit does not depend on a control loop using voltage measurement and feedback, the delivery of the auxiliary current can be done practically instantaneously.

Although FIG. 6 shows the power delivery unit being enabled at the same time that the baseband processor increases its power consumption (e.g., on the same clock pulse at 604), other embodiments are also possible. For example, in other embodiments, the power delivery unit 506 can deliver auxiliary current to the baseband processor 504 just before the baseband processor demands increased power. This may be advantageous because it helps to ensure that the supply voltage from the voltage regulator 502 remains sufficiently high to enable proper functionality.

Further, although FIG. 6 shows the current delivered by the power delivery unit 506 as corresponding precisely to the increase in current required by the circuit block 106, in other embodiments the power delivery unit can "overcompensate" for the increase in current required by the circuit block 106. See FIG. 13 further herein for additional details.

Figure 7:
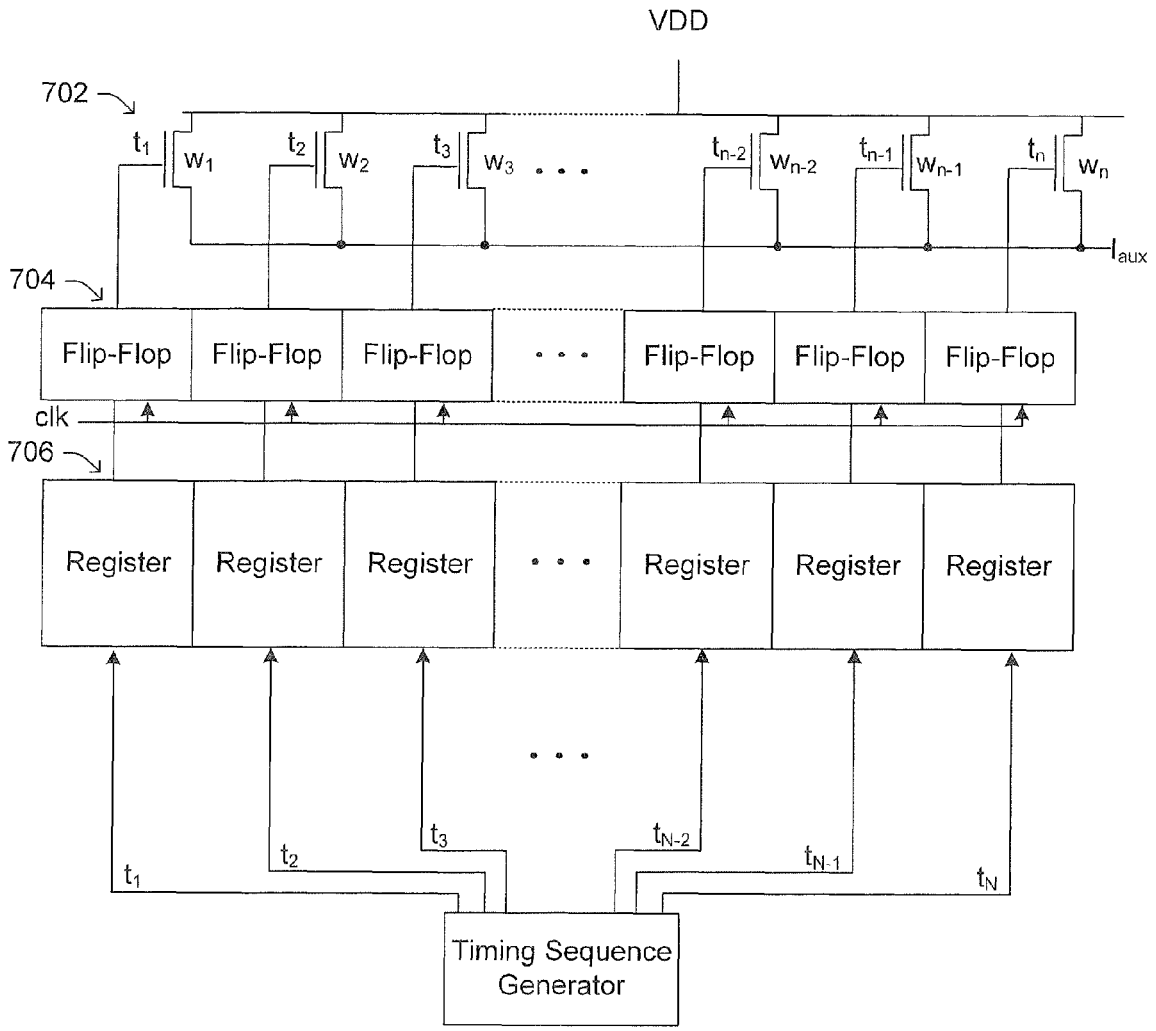
FIG. 7 illustrates an example power delivery unit.

Turning now to FIG. 7, one can see an auxiliary power delivery unit 700 (e.g., power delivery unit 506). As can be seen from FIG. 7, the power deliver unit has several power delivery elements 702 in the form of transistors. These transistors interface on one side to VDD, the gates of the transistors being connected in each case to flip-flops 704. The flip-flop elements 704 are running at clock clk and receive the data from a register unit 706. The register unit 706 can contain patterns of instruction sequences, which are passed to the flip-flops. If, for example, a gate signal is at a logical 1, the corresponding NFET transistor becomes conducting, which generates an auxiliary current source. If, for example, there is to be a load increase, as shown in FIG. 6 (at 604), then the individual transistors must successively deliver current, so that a current flow is generated as shown with 608 in FIG. 6. For this, an instruction sequence must be passed from the register unit 706 to the flip-flops 704 in such a way that, in the example shown, a large number of flip-flops are initially at a logical 1, and the flip-flops are gradually switched to logical 0 so auxiliary current is delivered with the desired time characteristics. Although FIG. 7 shows NFET transistors, PFET transistors could also be used, provided the logical 1s and 0s are inverted as is appreciated by one of ordinary skill in the art. Naturally, any form of control of the transistors is possible, so long as they can be made individually conducting. In some embodiments, multiple (or all) transistors can have the same length-to-width ratios, but in other embodiments the transistors can have different length-to-width ratios. In one embodiment the width of a transistor 'n+1' could be twice as great as the width Wn of the transistor 'n'. Since the power delivery is proportional to the transistor width, a smooth time characteristic can be achieved with a scaling of this nature.

Figure 8:
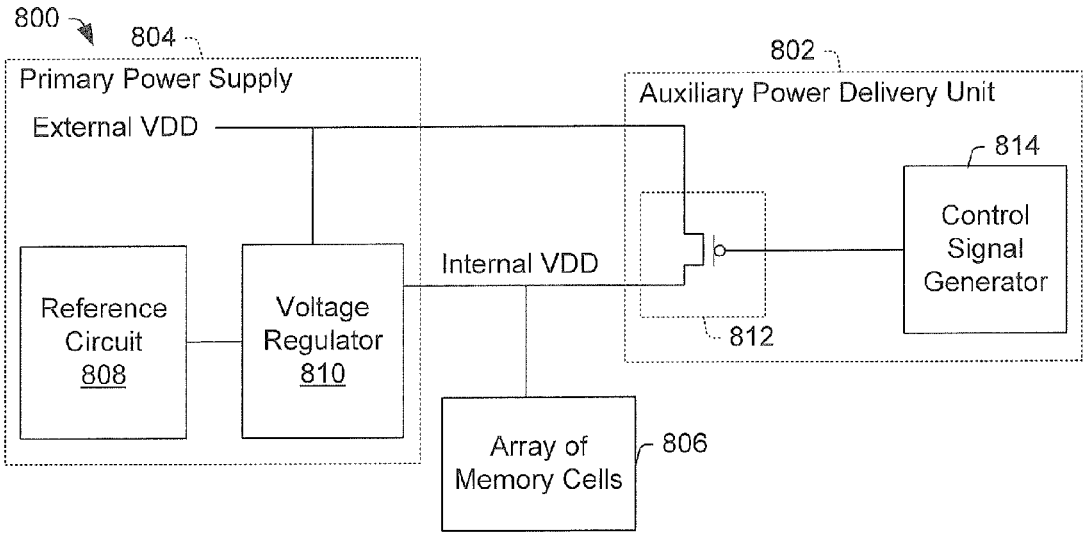
FIG. 8 illustrates an example of a circuit unit in the context of a memory device.

FIG. 8 shows another embodiment where an auxiliary power delivery unit 802 is included in the context of a memory device 800 (e.g., a SRAM memory device) being in a standby mode. In this mode of operation, only slowly varying currents are to be supplied to the memory. These current comprise the leakage current of the transistors. This current strongly depends on the temperature, and can vary by factors up to 50 or 100 within the allowable range of temperature. The memory device 800 includes a primary power supply 804 that provide an internal supply voltage to a memory array 806. The primary power supply 804 includes a reference circuit 808 configured to provide a reference voltage, and a voltage regulator 810 configured to supply the internal supply voltage based on both the reference voltage and an external supply voltage. The auxiliary power delivery unit 802 includes a transistor 812 and a control signal generator 814.

Figure 9:
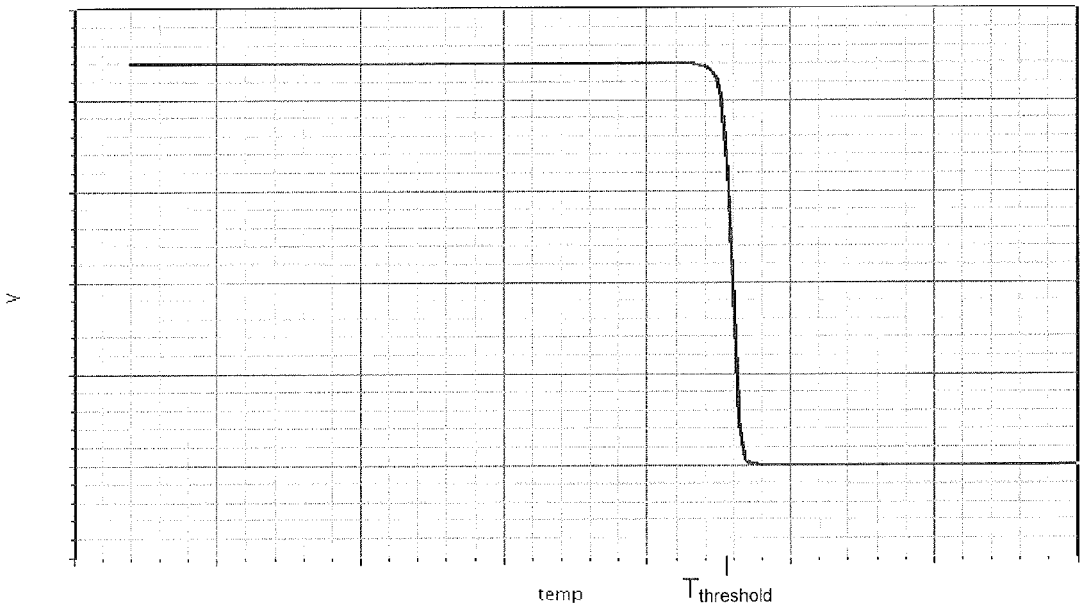
FIG. 9 illustrates a temperature dependent control signal in the use of the circuit of FIG. 8.

In this example, rather than being generated by a software program module as in some previous embodiments, a control signal from the control signal generator 814 can be generated in temperature dependent fashion as shown in FIG. 9, for example. For example, at temperatures less than a threshold temperature, the control signal can deactivate the transistor 812. Conversely, for temperatures above the threshold temperature (e.g., above 85° C.), the control signal can activate the power delivery unit 802, thereby supplying auxiliary power to the memory array 806 for temperature above the threshold temperature. This advantageously compensates for the fact that the memory cells in the array use more power as the temperature increases. Thus, the control signal generator and auxiliary power delivery unit cooperatively support the standby functionality, and allow the use of a smaller voltage regulator than in previous implementations.

Figure 14:
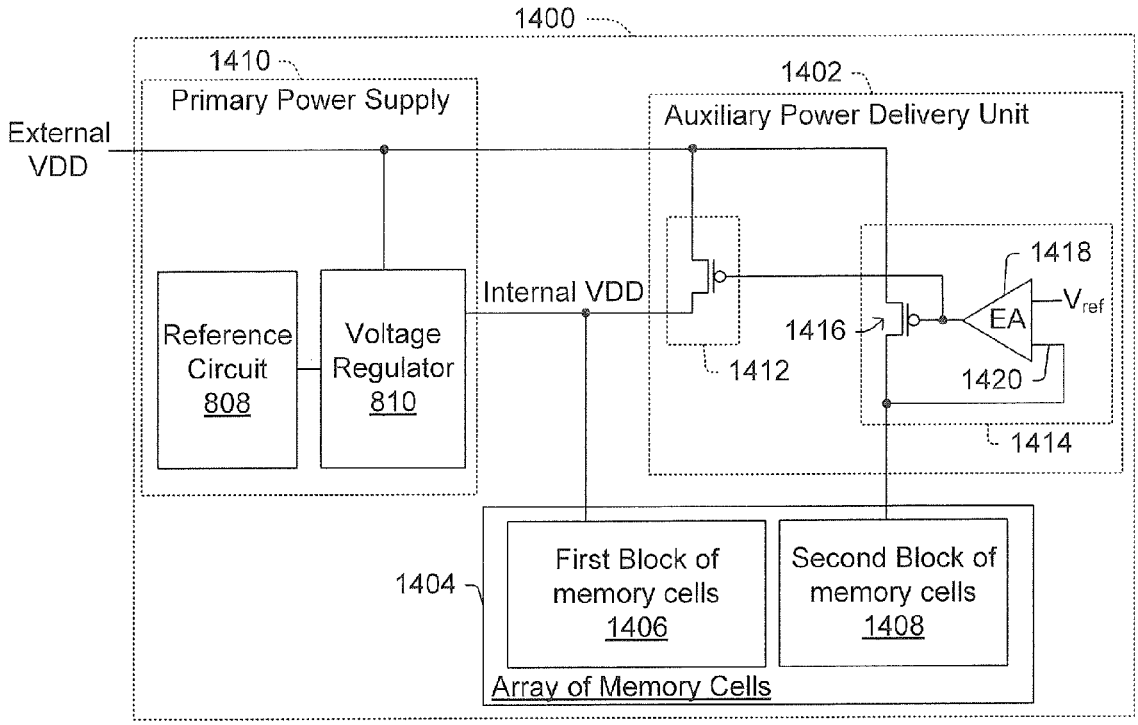
FIG. 14 illustrates an example of a circuit in the context of a memory device.

FIG. 14 shows another embodiment of an auxiliary power delivery unit 1402 in the context of a memory device (e.g., a SRAM memory device). In this example, the memory device includes a memory array 1404 arranged on at least one integrated circuit 1400, wherein the memory array 1404 includes at least two blocks of memory cells (e.g., a first block of memory cells 1406 and a second block of memory cells 1408). The second block of memory cells 1408 is often smaller than the first block of memory cells 1406 (e.g., second memory block is 1/10 total size of array and first memory block is 9/10 of total size of array), although it could also be larger or equal in other embodiments. The first block of memory cells 1406 receives power in the form of an internal VDD, which is supplied primarily by the primary power supply 1410. However, under some conditions (e.g., high temperature), the first block of memory cells 1406 may draw more power than the primary power supply 1410 is capable of providing. Therefore, an auxiliary power delivery unit 1402 is also included.

Like FIG. 8's auxiliary power delivery unit, FIG. 14's auxiliary power delivery unit 1402 includes a transistor 1412 and a control signal generator 1414. In this implementation, the control signal generator 1414 includes a p-type transistor 1416 and an error amplifier 1418. The error amplifier 1418 includes a first pin 1420 to monitor the power required by the second block of memory cells 1408, as represented by a monitored voltage. This monitored voltage is then compared to a reference voltage, Vref. If the power required by the second block of memory cells increases (e.g., due to an increase in temperature, voltage, or process considerations), the error amplifier adjusts the gate voltage supplied to the transistor 1416, inducing an increase in power supplied to the second block of memory cells 1408. Because the error amplifier 1418 provides power to gates of both transistors 1416, 1412, an increase in power required by the second block of memory cells 1408 also causes a corresponding increase in power supplied to the first block of memory cells 1406. In this way, the control signal generator 1414 provides auxiliary current to the array of memory cells to compensate for increased power requirements.

Often the signal from the error amplifier goes through a low pass filter to reach the gate of transistor 1412. Transistor 1412 is able to respond to low frequency variations of the current needed in the memory array, such as those dependant on temperature. In this way, transistor 1412 acts as a voltage regulator and provides auxiliary power to first block of memory cells 1406, for instance when temperature increases. The path through transistor 1412 to internal VDD is outside any regulation loop, this relaxes the constraint on the both regulators 810, 412. As a consequence, the power consumption of the two regulators (810, 1412) is significantly reduced.

Figure 10:
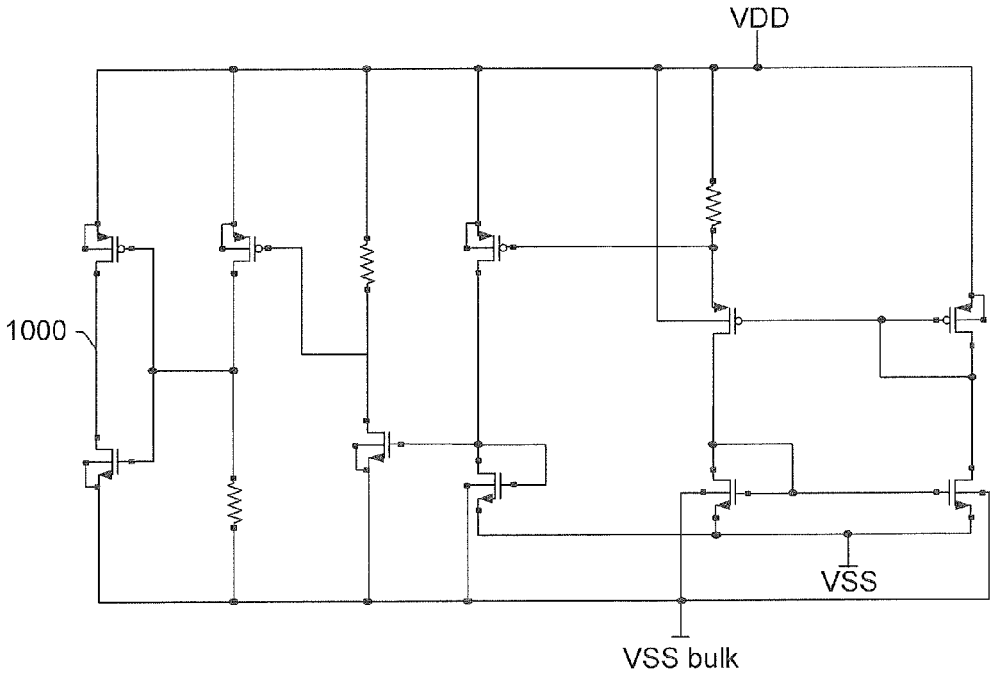
FIG. 10 illustrates an example control signal generator in the use of the circuit of FIG. 8.

FIG. 10 shows an embodiment of a control signal generator, which, for example, can be consistent with control signal generator of FIG. 8-9. The control signal generator includes an inverter to buffer the output, a bootstrapped current source, as well as an arrangement of resistors and transistors. The control signal generator generates a temperature-dependent control signal, such as shown in FIG. 9, for example, where the temperature-dependent control signal is delivered at node 1000.

Figure 11:
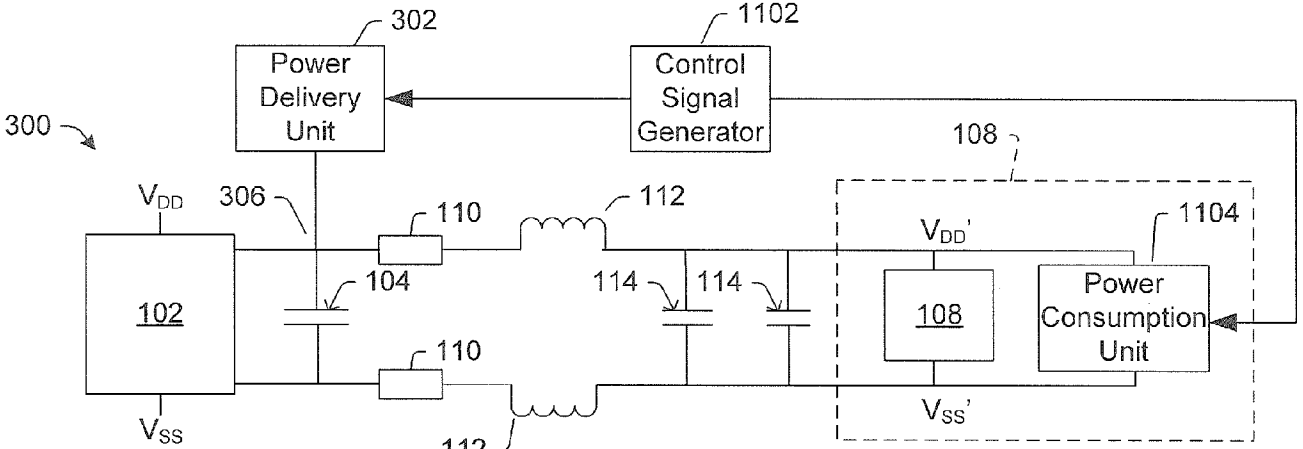
FIG. 11 illustrates a circuit that includes a power delivery unit and a power consumption unit.
Figure 12:
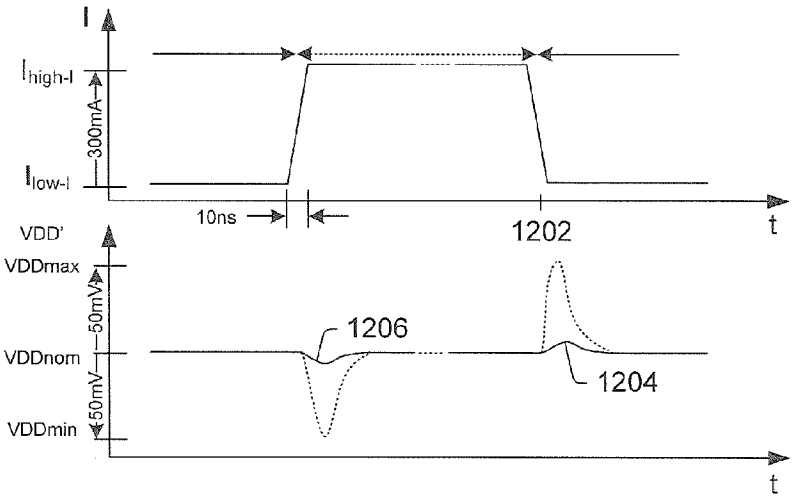
FIG. 12 illustrates a load change in the use of the circuit of FIG. 11.

FIGS. 11-12 show another embodiment of a circuit 1100, wherein the control signal generator 1102 selectively activates a power consumption unit 1104 (in addition selectively activating the previously discussed power delivery unit 1106). As shown in FIG. 12, the power consumption unit 1104 can be selectively activated when the circuit 106 changes from a high-current state to a low-current state at time 1202. The power consumption unit 1104 often consumes more power when first enabled, and then consumes less power as time progresses, thereby helping to avoid current overshoot as shown by line 1204. In combination with the power delivery unit 302 (which limits undershoot as shown by line 1206), the circuit of FIG. 11 helps to limit undesirable voltage swings.

Figure 13:
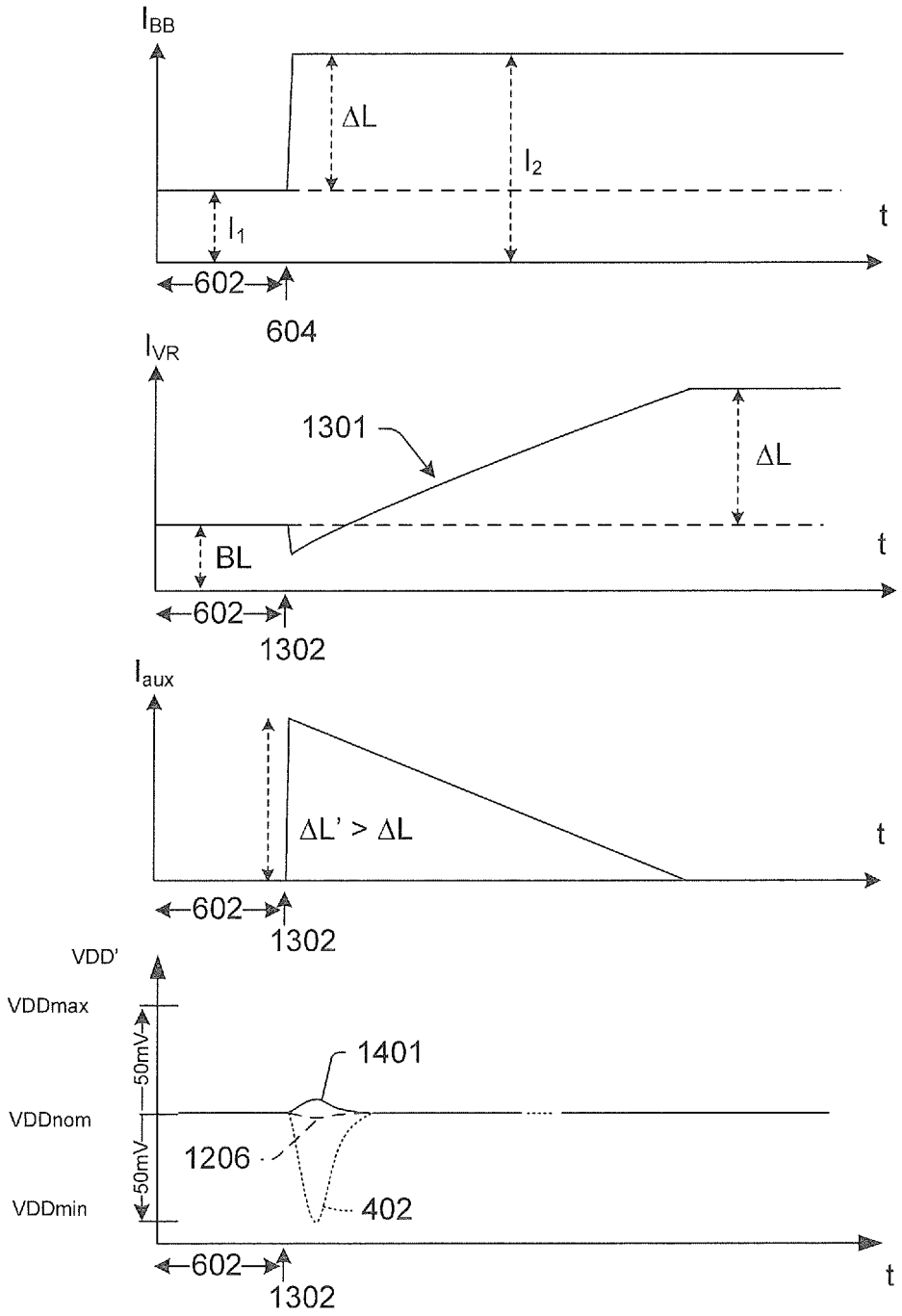
FIG. 13 illustrates an example of one manner in which an auxiliary power delivery unit can overcompensate for a load change in accordance with some embodiments.

FIG. 13 shows another embodiment where an auxiliary power delivery unit (e.g., auxiliary power delivery unit of 302 of FIG. 3) can provide current overcompensation. In this example, rather than the current supplied by the auxiliary power delivery unit being at least approximately equal to the change in current drawn by a circuit block (e.g., circuit block 106 in FIG. 3), the auxiliary power delivery unit provides auxiliary current having a current magnitude that is larger than the change in current drawn by the current block. In this instance, the circuit exhibits a slight overshoot on the supply voltage despite the load increase. For comparison, prior art circuits had a significant undershoot (see line 402), and previous embodiments had a very slight or no undershoot (see e.g., line 1206). This is advantageous in some instances, because it helps to guarantee that the supply voltage VDD' remains greater than VDDnom at substantially all times after startup during normal operation.

Although the disclosure has been shown and described with respect to one or more implementations, equivalent alterations and modifications will occur to others skilled in the art based upon a reading and understanding of this specification and the annexed drawings. In particular regard to the various functions performed by the above described components (e.g., elements and/or resources), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure. In addition, while a particular feature of the disclosure may have been disclosed with respect to only one of several implementations, such feature may be combined with one or more other features of the other implementations as may be desired and advantageous for any given or particular application. In addition, the articles "a" and "an" as used in this application and the appended claims are to be construed to mean "one or more".

Furthermore, to the extent that the terms "includes", "having", "has", "with", or variants thereof are used in either the detailed description or the claims, such terms are intended to be inclusive in a manner similar to the term "comprising."

What is claimed is:

1. An apparatus, comprising:

at least one circuit block;

a voltage source configured to supply a first voltage to the at least one circuit block;

a control unit configured to activate a control signal upon discerning an actual or expected change in power consumption of the at least one circuit block; and an auxiliary power delivery unit comprising multiple power delivery elements and a timing sequence generator, wherein the timing sequence generator is configured to provide a digital sequence to sequentially enable different combinations of the multiple power delivery elements to selectively deliver a predetermined quantity of current to the circuit block in addition to current supplied to the at least one circuit block by the voltage source based on activation of the control signal.

2. The apparatus of claim 1, wherein the actual or expected change in power consumption is an expected change in power consumption corresponding to a change in mode detected by a software program module.

3. The apparatus of claim 2, where the expected change in power consumption is detected without using a hardware voltage detection element and without using a hardware current detection element.

4. The apparatus of claim 1, wherein the multiple power delivery elements comprise multiple transistors.

5. The apparatus of claim 4, wherein the multiple power delivery elements are each controlled by a flip-flop.

6. The apparatus of claim 5, wherein the multiple power delivery elements comprise n-channel or p-channel transistors, wherein outputs of the flip-flops are connected to gate electrodes of the transistors.

7. The apparatus of claim 1, wherein, for a pending increase in power consumption of the at least one circuit block, the auxiliary power delivery unit is operable to deliver auxiliary current to the at least one circuit block before the pending increase in power consumption is actually initiated.

8. The apparatus of claim 7, wherein delivery of the auxiliary current by the auxiliary power delivery unit is reduced by turning off successive power delivery elements as the power delivered by the voltage source approaches a power required by the at least one circuit block.

9. The apparatus of claim 1, wherein the circuit block comprises a baseband processor.

10. The apparatus of claim 1, wherein the circuit block comprises a memory array.

11. The apparatus of claim 1, wherein the control unit is adapted to selectively activate the control signal based on whether a measured temperature has a predetermined relationship with a predetermined temperature threshold.

12. The apparatus of claim 1, wherein the control unit is configured to, upon the change in power consumption of the at least one circuit block, activate the control signal to deliver more total power to the circuit block than the circuit block is expected to utilize.

13. The apparatus of claim 1, where the expected change in power consumption is expected to follow a first predetermined curve over a time interval and wherein the timing sequence generator provides the digital sequence to selectively provide the predetermined quantity of current according to a second predetermined curve that differs from the first curve.

14. The apparatus of claim 13, wherein the first curve is a linear decreasing curve over the time interval and wherein the second curve is a linear increasing curve over the time interval.

15. The apparatus of claim 14 wherein the first curve has a first slope over the time interval and wherein the second curve has a second slope that is equal in magnitude but opposite in sign relative to the first slope over the time interval.

16. A circuit, comprising:

a primary power supply configured to provide an internal supply voltage, wherein the primary power supply comprises: a reference circuit configured to provide a reference voltage, and a voltage regulator configured to supply the internal supply voltage based on both the reference voltage and an external supply voltage;

an auxiliary power delivery unit comprising multiple individually controlled power delivery elements and a timing sequence generator;

at least one circuit block coupled to both the primary power supply and the auxiliary power delivery unit, wherein the at least one circuit block is configured to consume different quantities of power for different respective modes; and a control unit configured to, upon a change in power consumption of the at least one circuit block, activate the auxiliary power delivery unit to deliver a predetermined power profile to the circuit block in addition to the internal supply voltage supplied to the at least one circuit block by the primary power supply;

wherein the timing sequence generator is configured to provide a digital sequence to sequentially enable different combinations of the multiple power delivery elements to selectively deliver the predetermined power profile to the circuit block.

17. The circuit of claim 16, wherein the at least one circuit block comprises an array of memory cells.

18. The circuit of claim 16, wherein the control unit is adapted to selectively activate the auxiliary power delivery unit based on whether a measured temperature has a predetermined relationship with a predetermined temperature threshold.

19. The circuit of claim 16, wherein the change in power consumption of the at least one circuit block is an increase in power consumption corresponding to a change in mode detected by a program module, and wherein the control unit is operable to activate the power delivery unit to deliver the quantity of power to correlate to the increase in power consumption.

* * * * *